US008777235B2

(12) United States Patent
Ng et al.

(10) Patent No.: US 8,777,235 B2
(45) Date of Patent: Jul. 15, 2014

(54) BRAKING MECHANISM FOR ROLLER SKATES

(71) Applicant: Koncept Technologies Inc., Monrovia, CA (US)

(72) Inventors: Kenneth Yat Chung Ng, Alhambra, CA (US); Edmund Yat Kwong Ng, Pasadena, CA (US)

(73) Assignee: Koncept Technologies Inc., Monrovia, CA (US)

( * ) Notice: Subject to any disclaimer, the term of this patent is extended or adjusted under 35 U.S.C. 154(b) by 0 days.

(21) Appl. No.: 13/791,745

(22) Filed: Mar. 8, 2013

(65) Prior Publication Data

US 2013/0277924 A1 Oct. 24, 2013

Related U.S. Application Data

(60) Provisional application No. 61/637,764, filed on Apr. 24, 2012.

(51) Int. Cl.
*A63C 17/14* (2006.01)

(52) U.S. Cl.
USPC ..... 280/11.211

(58) Field of Classification Search
USPC ..... 280/11.204, 11.205, 11.211, 11.212, 280/11.214–11.217
See application file for complete search history.

(56) References Cited

U.S. PATENT DOCUMENTS 5,232,231 A * 8/1993 Carlsmith ..... 280/11.215
5,415,419 A * 5/1995 Bourque ..... 280/11.214
5,439,238 A * 8/1995 Neal ..... 280/11.212
5,465,984 A * 11/1995 Pellegrini et al. ..... 280/11.214
5,564,718 A * 10/1996 Mitchell et al. ..... 280/11.212
5,590,889 A * 1/1997 Pozzobon ..... 280/11.214
5,649,715 A * 7/1997 Mitchell ..... 280/11.214
5,651,556 A * 7/1997 Mitchell ..... 280/11.212
5,655,783 A * 8/1997 Brosnan ..... 280/11.214
5,664,794 A * 9/1997 Mitchell et al. ..... 280/11.212
5,704,619 A * 1/1998 Mitchell et al. ..... 280/11.216
5,865,445 A * 2/1999 Svensson et al. ..... 280/11.214
5,868,404 A * 2/1999 Montague ..... 280/11.213
5,895,060 A * 4/1999 Marchesin et al. ..... 280/11.214
5,924,704 A * 7/1999 Johnson ..... 280/11.211
5,934,691 A * 8/1999 Stivali ..... 280/11.212
5,992,862 A * 11/1999 Mitchell ..... 280/11.216
6,032,974 A * 3/2000 Saillet ..... 280/611
6,065,761 A * 5/2000 Gignoux et al. ..... 280/11.214
6,273,436 B1 * 8/2001 Repucci ..... 280/11.217
6,425,586 B1 * 7/2002 Gorza et al. ..... 280/11.204
6,536,783 B2 * 3/2003 Gorza et al. ..... 280/11.204
6,729,628 B2 * 5/2004 Bellehumeur et al. ... 280/11.215
7,367,568 B2 * 5/2008 Lansel ..... 280/11.19
7,455,305 B2 * 11/2008 Bellehumeur et al. ... 280/11.215
7,762,563 B2 * 7/2010 Chuang ..... 280/11.19
7,926,824 B2 * 4/2011 Quendez ..... 280/11.214
8,556,274 B2 * 10/2013 Ellis ..... 280/11.214
2002/0158427 A1 * 10/2002 Gorza et al. ..... 280/11.216
2003/0107194 A1 * 6/2003 Bellehumeur et al. ... 280/11.215

(Continued)

*Primary Examiner* — Jeffrey J Restifo
*Assistant Examiner* — Erez Gurari
(74) *Attorney, Agent, or Firm* — Foley & Lardner LLP

(57) ABSTRACT

A roller skate device, including: at least one skate wheel. A cradle including a control wire. And a lever system coupled to the control wire, the lever system including at least one brake wheel that applies a braking force to the at least one skate wheel based on the motion of the cradle translated through the control wire.

18 Claims, 16 Drawing Sheets

(56) References Cited

U.S. PATENT DOCUMENTS

| | | | | |
|---|---|---|---|---|
| 2003/0168822 | A1* | 9/2003 | Bellehumeur et al. | 280/11.215 |
| 2006/0097465 | A1* | 5/2006 | Lansel | 280/11.204 |
| 2006/0181036 | A1* | 8/2006 | Tremblay | 280/11.212 |
| 2006/0273532 | A1* | 12/2006 | Johnson | 280/11.214 |
| 2007/0132201 | A1* | 6/2007 | Bellehumeur et al. | 280/87.041 |
| 2013/0075987 | A1* | 3/2013 | Bellehumeur et al. | 280/11.215 |
| 2013/0200580 | A1* | 8/2013 | Ellis | 280/11.214 |
| 2013/0277924 | A1* | 10/2013 | Ng et al. | 280/11.214 |

* cited by examiner

100

100

120

BRAKING MECHANISM FOR ROLLER SKATES

CROSS-REFERENCE TO RELATED PATENT APPLICATIONS

This application relates to and claims priority from U.S. Provisional Application 61/637,764, filed Apr. 24, 2012, incorporated herein by reference in its entirety.

BACKGROUND

The present disclosure relates to braking mechanisms for roller skates and other similar devices, and, in particular embodiments, to braking mechanisms that provide braking functionality without having to rely on an actual physical brake or brake pad but by simply having the user lean backwards or make a similar motion. The user may also lean forwards or stand straight or make a similar motion to release the brake as well. The user also can still use both feet instead of having to use just one foot for braking, which is what a user must usually do with traditional roller skates having brake pads.

SUMMARY OF THE DISCLOSURE

According to an aspect of the present disclosure, provided is a roller skate device, including: at least one skate wheel. A base comprising a control wire. A cradle comprising a locking mechanism. And a lever system coupled to the control wire, the lever system comprising at least one brake wheel that applies a braking force to the at least one skate wheel based on the motion of the cradle translated through the control wire.

According to an aspect of the present disclosure, provided is a method including the steps of translating a momentum from a control wire controlled by a cradle to a lever system when the cradle is moved in a first position. Having the lever system apply a braking force upon at least one skate wheel of a roller skate device from the translated momentum. Releasing the momentum to the lever system when the cradle is moved in a second position. And, having the lever system release the braking force upon the at least one skate wheel of the roller skate device and restoring the lever system to its original position by a biased force internal to the lever system.

DETAILED DESCRIPTION OF THE EMBODIMENTS

In the following description of preferred embodiments, reference is made to the accompanying drawings which form a part hereof and in which are shown by way of illustration specific embodiments in which the invention may be practiced. It is to be understood that other embodiments may be utilized and structural changes may be made without departing from the scope of the preferred embodiments of the present disclosure.

The present disclosure relates to braking mechanisms for roller skates and other similar devices, and, in particular embodiments, to braking mechanisms that provide braking functionality without having to rely on an actual physical brake or brake pad but by simply having the user lean backwards or make a similar motion. The user may also lean forwards or stand straight or make a similar motion to release the brake as well. The user also can still use both feet instead of having to use just one foot for braking, which is what a user must usually do with traditional roller skates having brake pads.

This braking mechanism can be applied to roller skate devices in general, such as inline skates, rollerblades, or any other similar device with wheels such as shoes with roller skates on the heel, bicycles, tricycles, segways, and even automobiles of all types with four wheels. Currently, traditional roller skate devices on the market normally incorporate a physical brake pad behind the rear wheel. However, the present disclosure provides a number of advantages over the standard brake pad design, and does away with having to rely on a brake pad.

Figure 1:
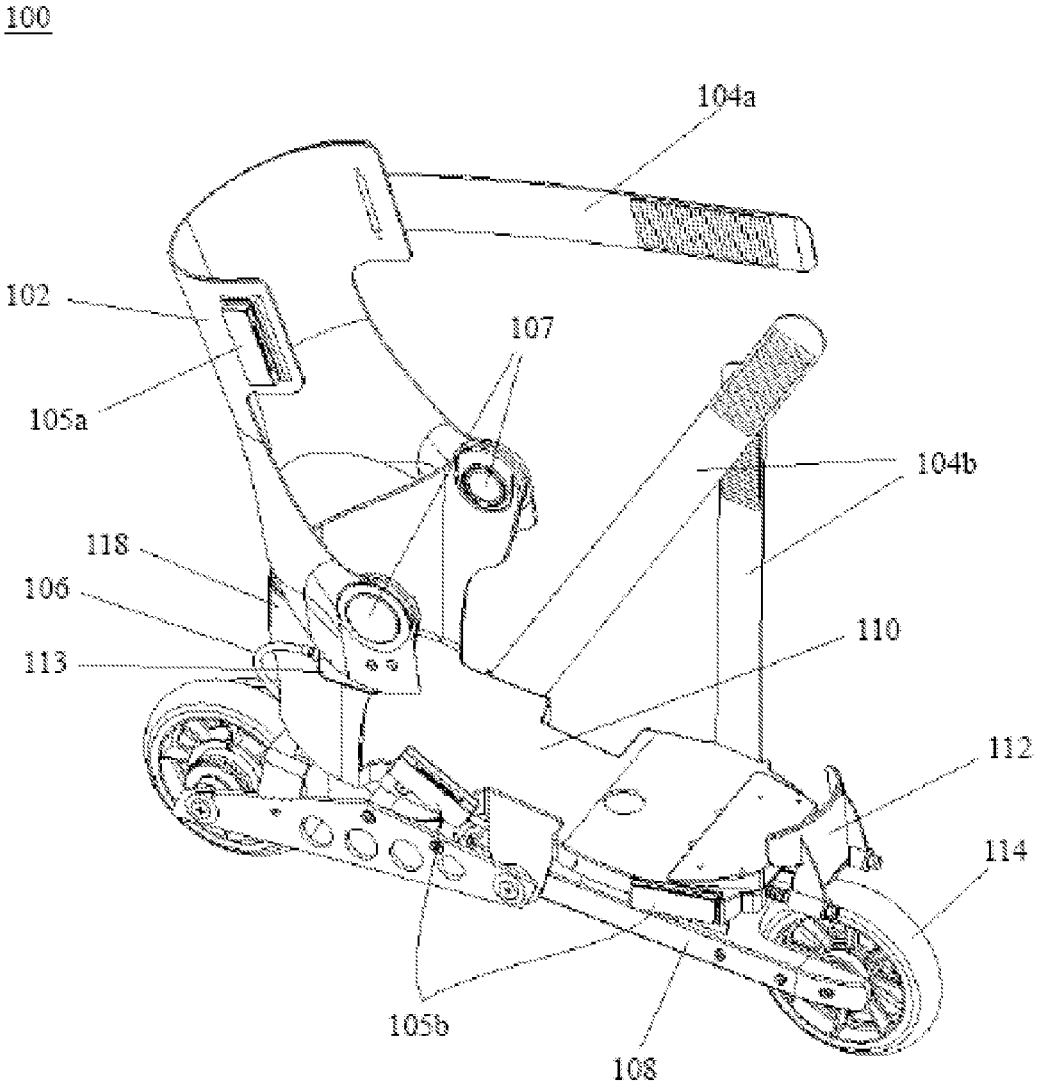
FIG. 1 is a perspective view of a roller skate device having the braking mechanism according to an embodiment of the present disclosure.

FIG. 1 is a perspective view of a roller skate device having the braking mechanism according to an embodiment of the present disclosure. The roller skate device 100 includes a cradle 102, foot strap 104*a*, shoe straps 104*b*, foot strap buckle 105*a*, shoe strap buckles 105*b*, a control wire 106, ankle joints 107, a chassis 108, a base 110, a toe cap 112, a compartment case 113, a skate wheel 114, and a rear shoe block 118.

The user's foot and shoe is secured into the cradle 102 with the sole of the user's foot and shoe securely contacting the base 110, the toe of the user's foot securely positioned within the toe cap 112, and the user's foot and shoe being strapped in by means of the foot strap 104*a* being secured into the foot strap buckle 105*a* and the shoe straps 104*b* being secured into the shoe strap buckles 105*b*. The foot strap 104*a*, shoe straps 104*b*, foot strap buckle 105*a* and shoe strap buckles 105*b* may not necessarily be limited to the configuration shown, and may include, for example, a velcro-type of setup, a latch set-up, magnets, buttons, shoelaces or strings and any other similar securing mechanism. The ankle joints 107 are designed to secure the ankles of the user's foot and shoe, and may be padded or have holes for ventilation or airflow. The toe cap 112 may also be padded in order to make the user's toes, which may be within a shoe, more comfortable. The rear shoe block 118 also provides a housing structure in which the user may securely rest the heel of his or her foot and shoe.

Figure 6A:
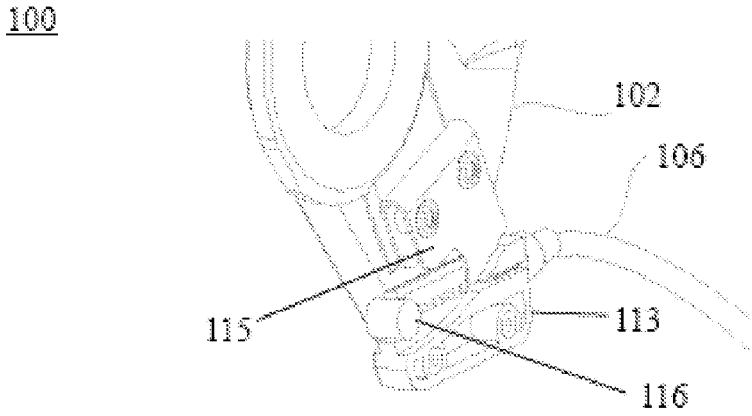
FIGS. 6A-C are perspective, partially exploded views of the control wire based system used in the braking mechanism on the roller skate device according to an embodiment of the present disclosure.
Figure 6B:
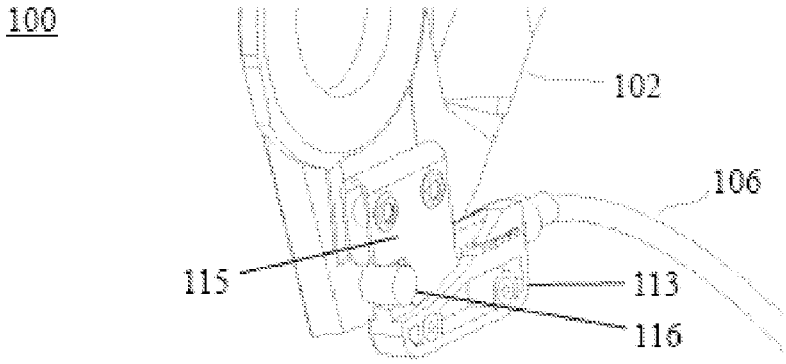
Figure 6C:
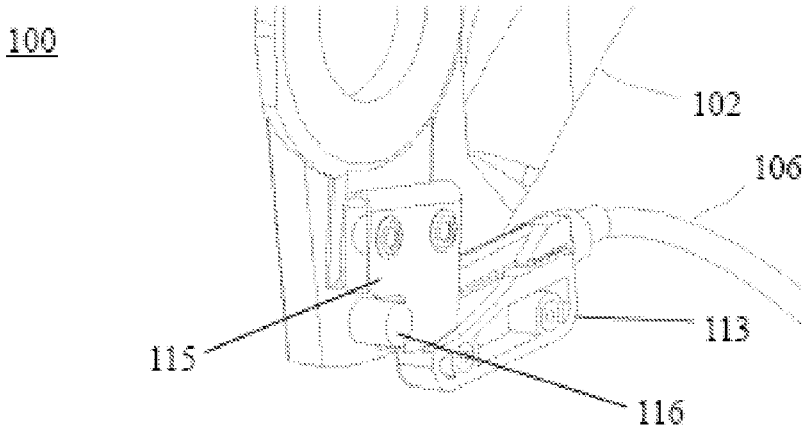

In order to initiate braking and use the braking mechanism, the user may lean backwards so that the cradle 102 is tilted backward. The cradle 102 may rotate about a joint that may be connected to the bottom half of the roller skate device 100, and the joint does not rotate. The control wire 106 is attached to the roller skate device 100 in a way so that when the cradle 102 is tilted backwards, the control wire 106 will be engaged and pulled, as shown in FIGS. 6A-C, for example, and which will trigger the braking mechanism, as will be explained in more detail below.

The second end of the control wire 106 is attached to the lever system 120 (as explained in further detail in FIGS. 8A-B, 9A-B, 10A-B and 11A-B). The lever system 120 essentially is able to achieve braking by pressuring two small wheels 1208 onto the skate wheel 114, thereby slowing down the skate wheel 114 when the control wire 106 is pulled. The skate wheel 114 also provides the motion for the roller skate device 100. The chassis 108 also provides support for the overall structure of the roller skate device 100 and also may be an additional securing structure to connect the base 110 or the roller skate device 100 to the skate wheels 114. Compartment case 113 will be explained below in FIG. 4.

Figure 2:
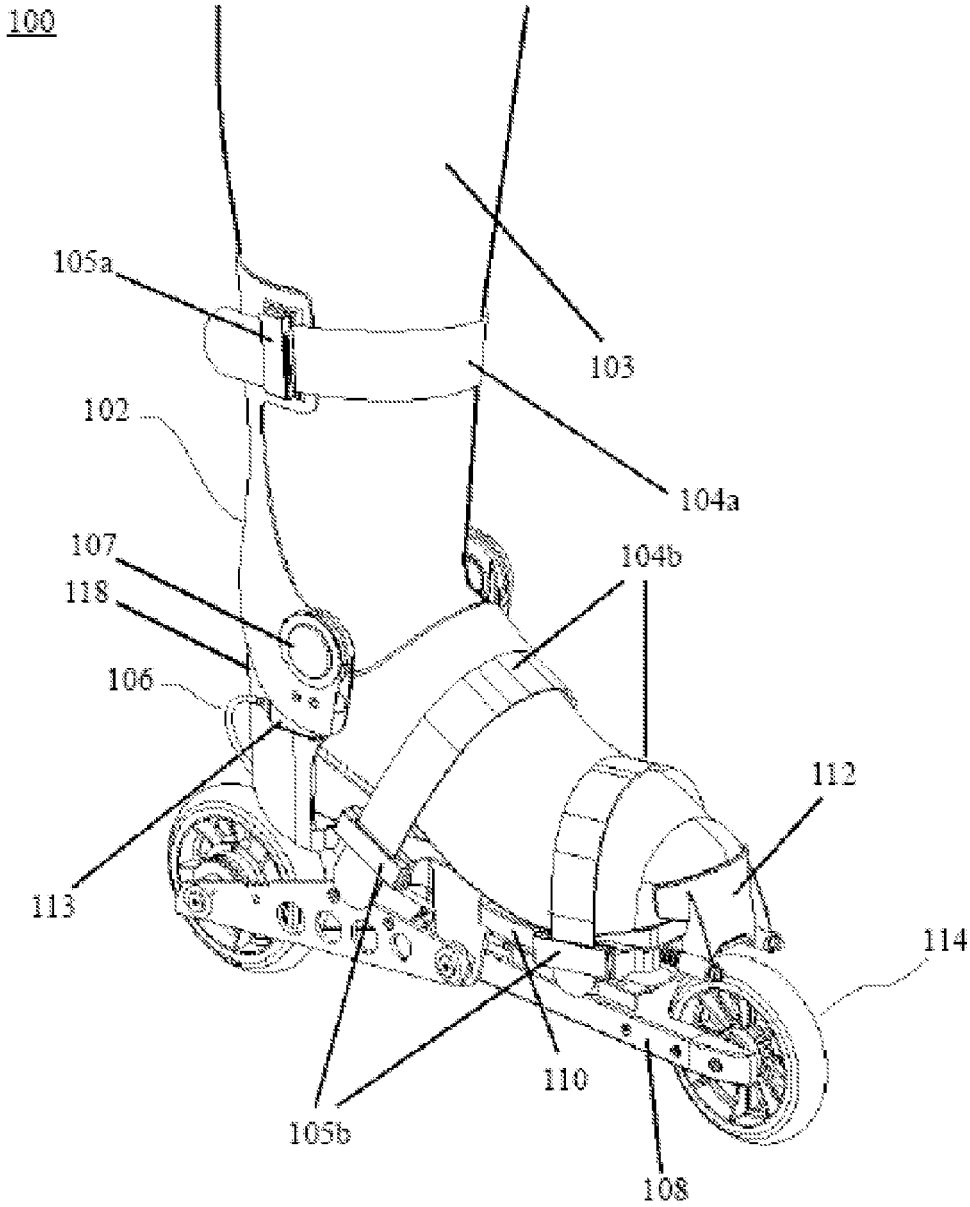
FIG. 2 is a perspective view of a roller skate device with a user's foot and shoe positioned within it, the roller skate device having the braking mechanism according to an embodiment of the present disclosure.

FIG. 2 is a perspective view of a roller skate device with a user's foot and shoe positioned within it, the roller skate device having the braking mechanism according to an embodiment of the present disclosure. FIG. 2 also shows the same elements as FIG. 1, but is positioned slightly to the side, and a user's foot and shoe 103 also is shown fitting into the cradle 102, the base 110 and the toe cap 112. The foot strap 104*a* is also fit and secured into the foot strap buckle 105*a* and the shoe straps 104*b* are fit and secured into the shoe strap buckles 105*b* so as to secure the user's foot and shoe 103. The ankles of the user's foot and shoe 103 also are positioned securely within the ankle joints 107. The heel of the user's foot and shoe 103 are also positioned securely within the rear shoe block 118. The user will use the skate wheels 114 to perform movement or motion on the roller skate device 100, and will lean backwards or make a similar motion to brake utilizing the control wire 106 and the lever system 120 (discussed below), or lean forwards or make a similar motion to release the brake utilizing the spring mechanism 1211 (discussed below).

Figure 3:
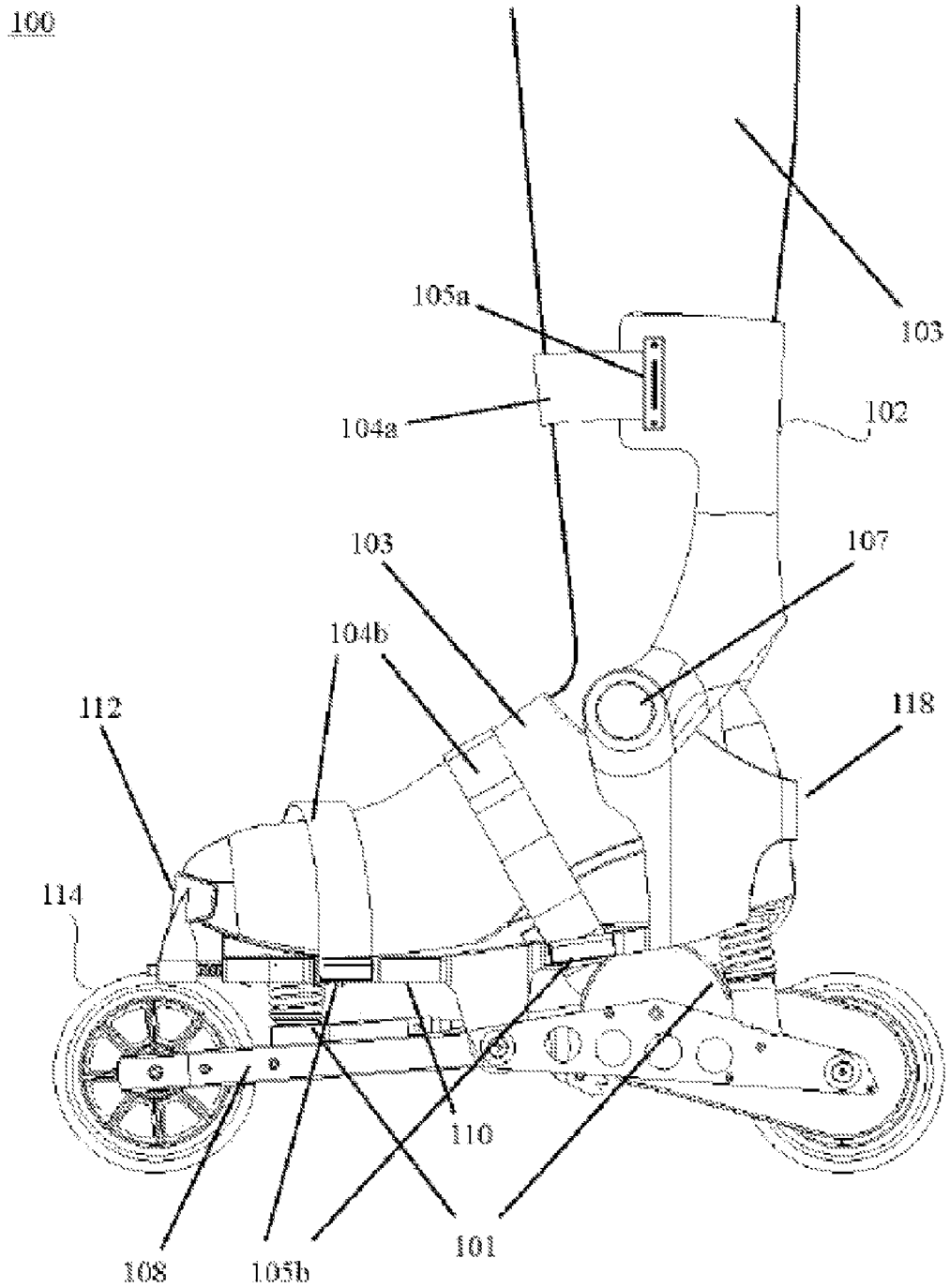
FIG. 3 is a side view of a roller skate device with a user's foot and shoe positioned within it, the roller skate device having the braking mechanism according to an embodiment of the present disclosure.

FIG. 3 is a side view of a roller skate device with a user's foot and shoe positioned within it, the roller skate device having the braking mechanism according to an embodiment of the present disclosure. FIG. 3 is identical to FIG. 2, but is instead a side view instead of a perspective view. Support springs 101 are also visible in this side view, whereas the control wire 106 is not. The support springs 101 of the roller skate device 100 provide support for the user's foot and shoe 103 inside the roller skate device 100 and also support for the base 110. The support springs 101 also provide support and flexibility when the roller skate device 100 lands on the ground or makes an impact or performs turns or makes other similar movements. The user's foot and shoe 103 can be seen secured within cradle 102 and tied in by means of foot strap 104*a* being secured with foot strap buckle 105*a* and shoe straps 104*b* being secured with shoe strap buckles 105*b*, the ankles secured within ankle joints 107, the heel secured within the rear shoe block 118, the toe of the user's foot and shoe 103 secured within the toe cap 112 and the sole of the user's foot and shoe 103 in contact with the base 110.

Figure 4A:
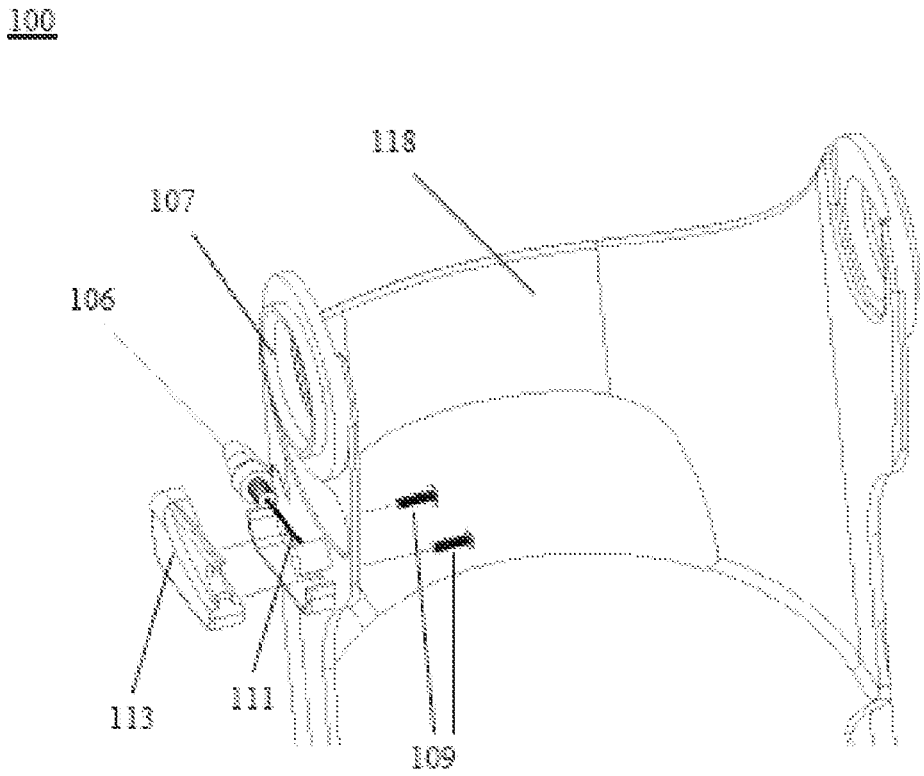
FIG. 4A-B are perspective, partially exploded views of the rear shoe block portion of the roller skate device having the braking mechanism according to an embodiment of the present disclosure.
Figure 4B:
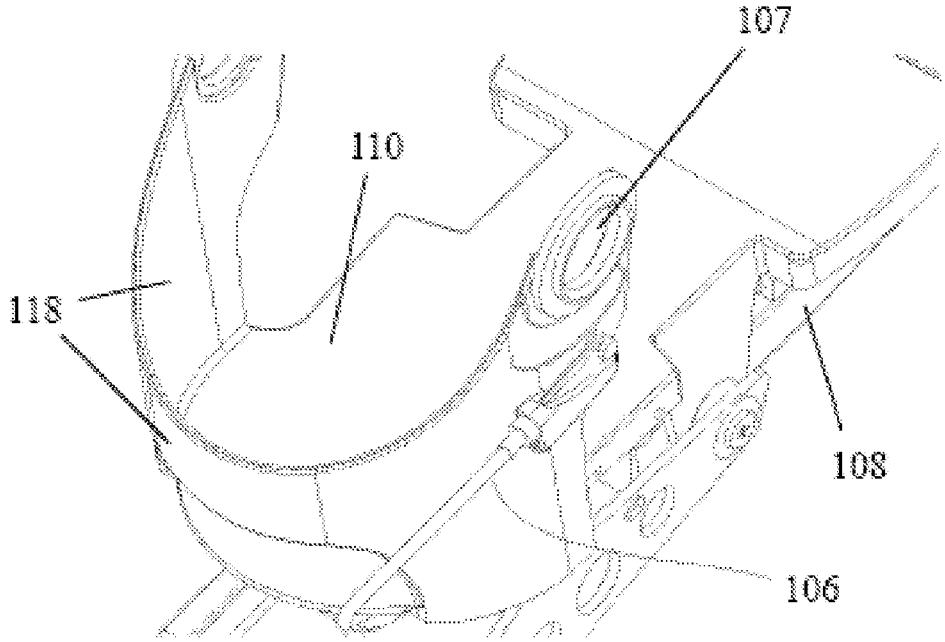

FIGS. 4A-B are perspective, partially exploded views of the rear shoe block portion of the roller skate device having the braking mechanism according to an embodiment of the present disclosure. FIG. 4A shows the rear shoe block portion of roller skate device 100 which includes the rear shoe block 118, the ankle joints 107, the control wire 106, screws 109, tension wire 111 and compartment case 113. The tension wire 111 is part of the control wire 106 and which controls the tension and pressure of the control wire 106 and the components connected to the control wire 106 when the control wire 106 is pulled or retracted or moved in any way. In other words, based on motion or movement of the user, the tension wire 111 translates movement to the control wire 106 which translates that movement to the lever system 120 or other components of the roller skate device 100. The operation of the tension wire 111 may not be visible, or the tension wire 111 may be protected from the outside environment, therefore compartment case 113 covers up the tension wire 106 with the screws 109 screwing the compartment case 113 into place. The screw 109 may not necessarily be screws and could be any adhesive or securing means that will fit the compartment case 113 securely into place. The tension wire 111 can also be made of any material or fiber that may withstand high levels of tension or pressure, or any material usually used to fabricate such wires. The ankle joints 107 may also be padded so as to provide cushioning for the ankles of the user's foot 103. FIG. 4B is another perspective, partially exploded view of the rear shoe block portion of the roller skate device having the braking mechanism according to an embodiment of the present disclosure. FIG. 4B shows the bottom portion of roller skate device 100, the components being visible including the rear shoe block 118, the base 110, the ankle joints 107, the control wire 106, and the chassis 108. FIG. 4B also does not show the user's foot and shoe 103 within the roller skate device 100 so as to get a better visualization of the structure of the roller skate device 100. The control wire 106 can also be seen with a coating in this case that shields the tension wire 111 that may be positioned within it.

Figure 5A:
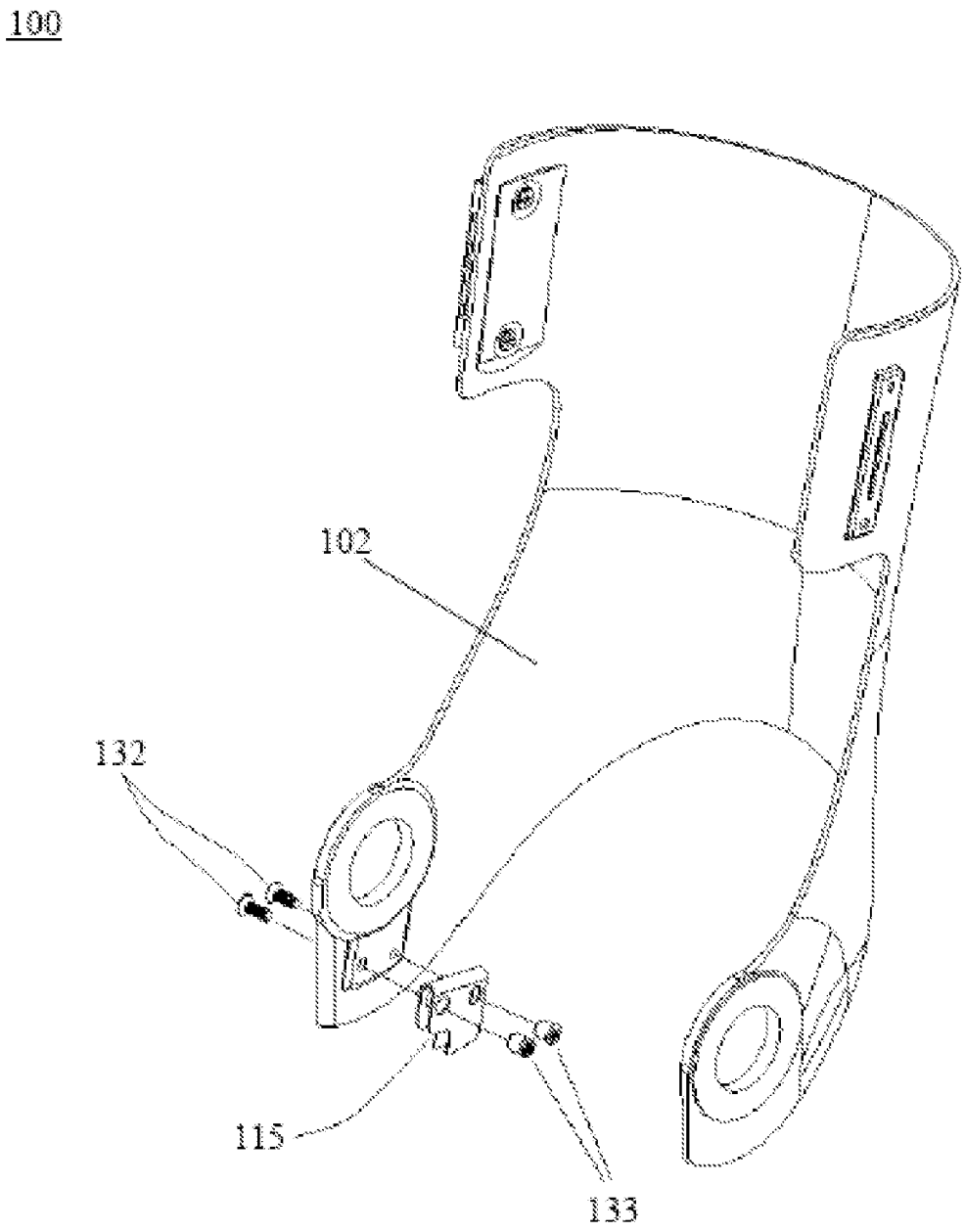
FIG. 5A is a perspective, partially exploded view of the cradle of the roller skate device having the braking mechanism according to an embodiment of the present disclosure.

FIG. 5A is perspective, partially exploded view of the cradle of the roller skate device having the braking mechanism according to an embodiment of the present disclosure.

Figure 5B:
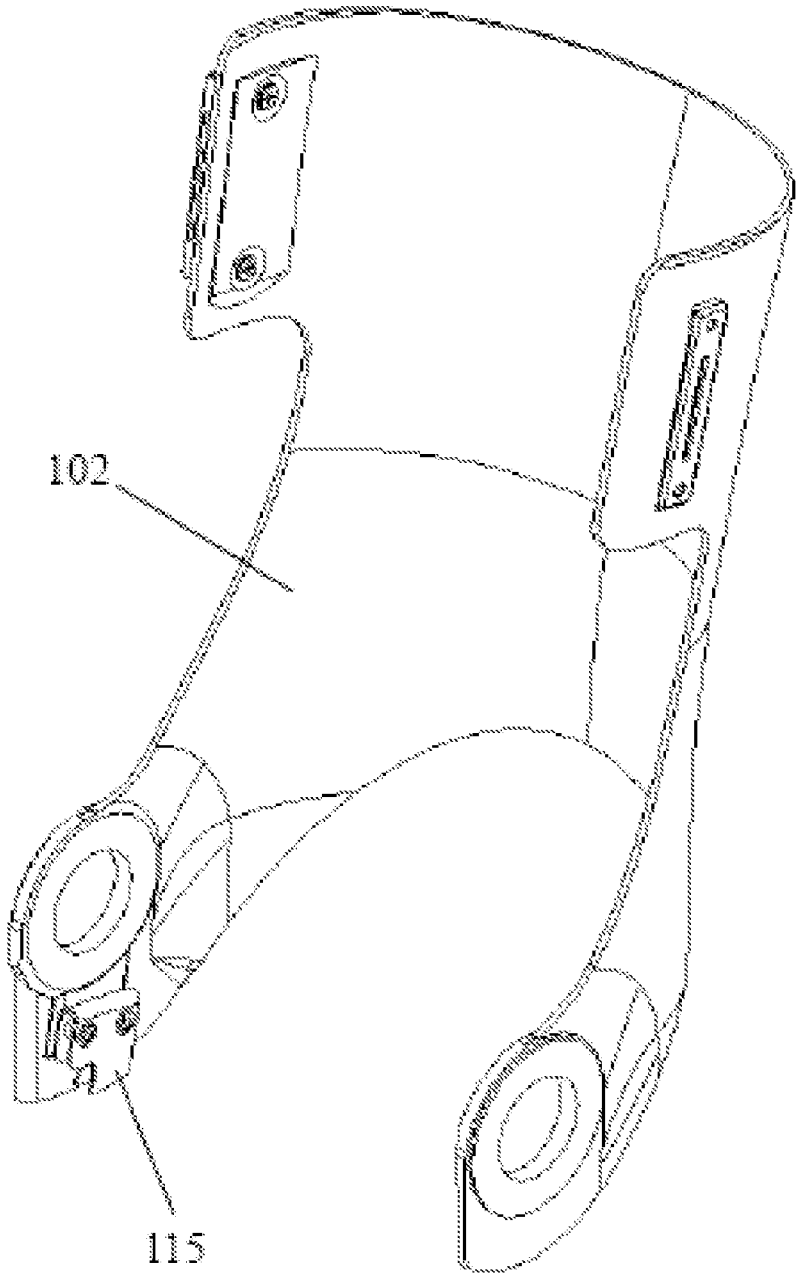
FIG. 5B is a perspective, assembled view of the cradle of the roller skate device having the braking mechanism according to an embodiment of the present disclosure.
Figure 5C:
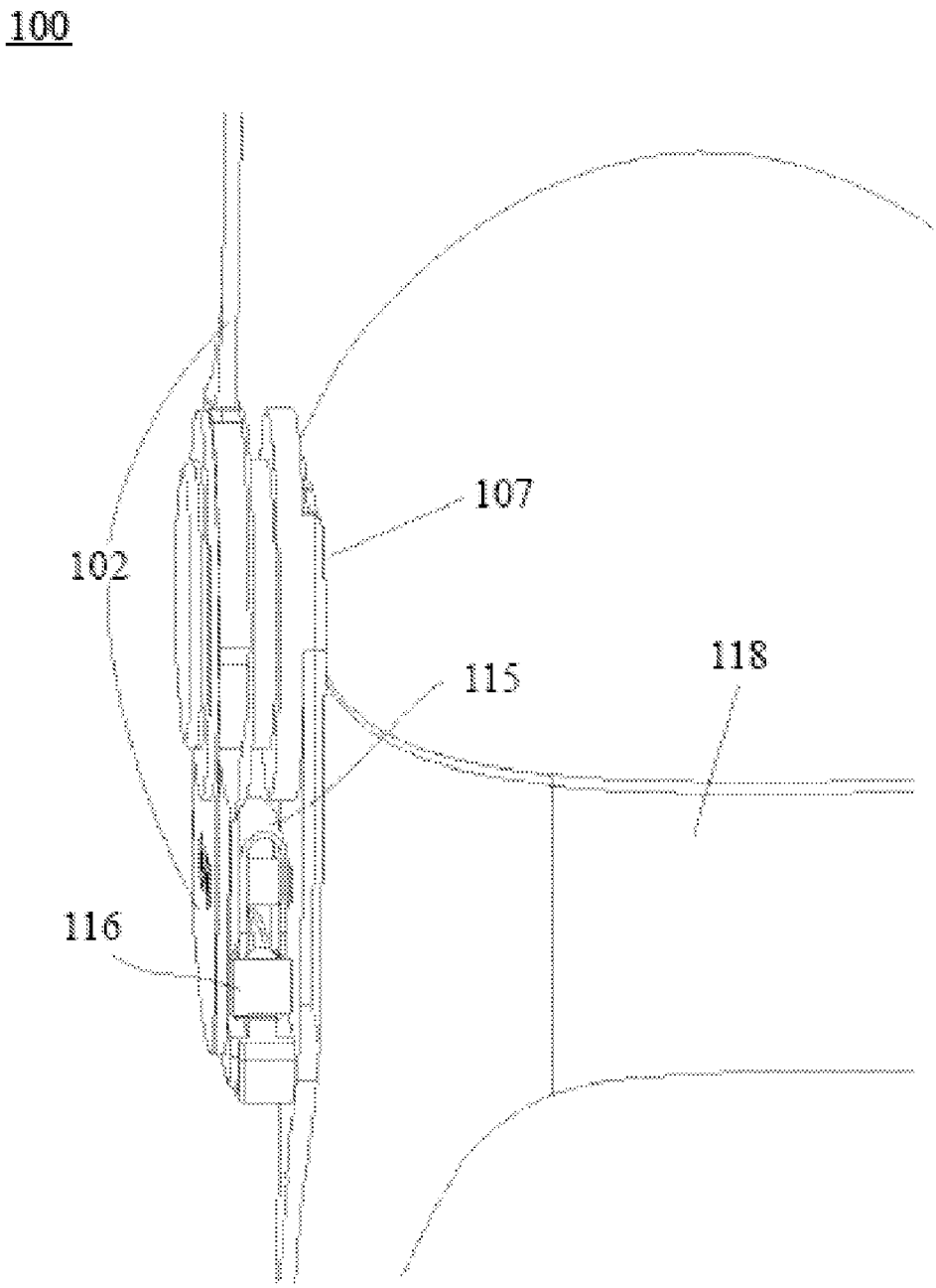
FIG. 5C is a front view of the ankle joint portion of the cradle, the locking mechanism, the peg part of control wire of the roller skate device having the braking mechanism according to an embodiment of the present disclosure.

FIG. 5A shows the cradle of roller skate device 100 which includes the cradle 102, the screws 132, the locking mechanism 115 and nuts 133. FIG. 5B is perspective view of the cradle of the roller skate device having the braking mechanism according to an embodiment of the present disclosure. FIG. 5B shows the locking mechanism 115 fastened to cradle 102. FIG. 5C is front view of the ankle joint portion of the cradle which includes the cradle 102, the ankle joint 107, the locking mechanism 115, the peg part 116 of control wire, the rear shoe block 118 of the roller skate device having the braking mechanism according to an embodiment of the present disclosure.

FIGS. 6A-C are perspective, partially exploded views of the control wire based system used in the braking mechanism on the roller skate device according to an embodiment of the present disclosure. FIGS. 6A-6C include the cradle 102, the control wire 106 and peg part 116, the locking mechanism 115 and the compartment case 113.

As the cradle 102 is tilted backwards, the peg part 116 of the control wire 106, shown non-engaged in FIG. 6A, will become engaged with the locking mechanism 115 in FIG. 6B. Then, the control wire 106 and the peg part 116 will be pulled as a result by the locking mechanism 115 as the cradle 102 is tilted backwards by the user's motion, as can be seen in FIG. 6C. In other words, once the peg part 116 of the control wire 106 becomes engaged with the locking mechanism 115, the backwards motion of the cradle 102 will cause the control wire 106 to be pulled. The pulling of the control wire 106 will send momentum to the lever system 120, discussed below. The movement of the user and/or the cradle may not necessarily be limited to a backwards motion and may include a forwards motion or a sideways motion or any other similar motion.

Figure 7:
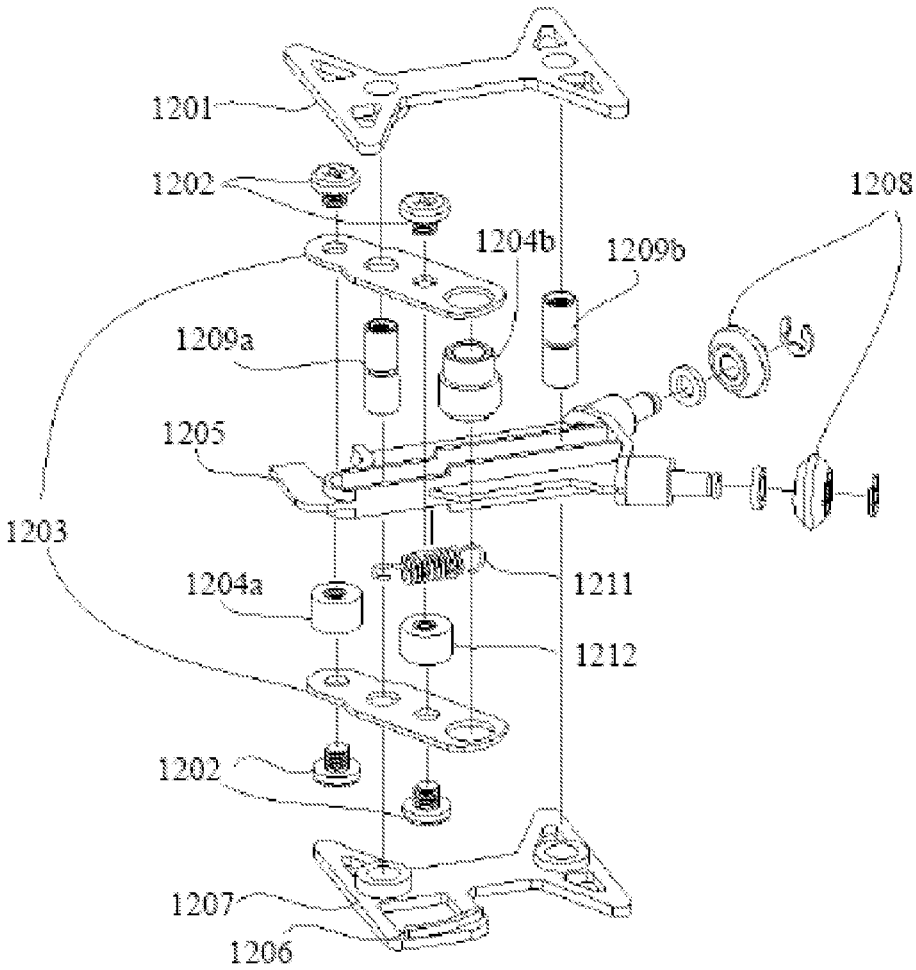
FIG. 7 is a perspective, partially exploded view of all the components making up the lever system used in the braking mechanism on the roller skate device according to an embodiment of the present disclosure.

FIG. 7 is a perspective, partially exploded view of all the components making up the lever system used in the braking mechanism on the roller skate device according to an embodiment of the present disclosure. The lever system 120 includes a top cap 1201, screws 1202, levers 1203, a first rotational wheel 1204*a*, a second rotational wheel 1204*b*, a first axis 1209*a*, a second axis 1209*b*, a spring mechanism 1211, a securer 1212, a slider 1205, a rail 1206, a bottom cap 1207, and brake wheels 1208. The second end, or end not shown in the above Figures (e.g. FIGS. 1-5, 6A-C) of the control wire 106, or the end of the control wire 106 being pulled, may be coupled to a hook 130 (shown in FIGS. 10B, 11A-B), which is in turn coupled to levers 1203. The levers 1203 rotate about an axis, such as securer 1212. At the other end of the lever 1203, is first rotational wheel 1204*a* which is engaged to an opening on the slider 1205. First axis 1209*a* and second axis 1209*b* are affixed to top cap 1201 and bottom cap 1207. First axis 1209*a* and second axis 1209*b* sit inside longitudinal openings in the middle of slider 1205 and act as vertical guide pins for the slider 1205 to move on. The securer 1212 secures the components including slider 1205, levers 1203, first and second rotational wheels 1204*a* and 1204*b*, first axis 1209*a*, together, with also aid from screws 1202. The screws 1202 also ensure all the above-described components within the lever system 120 are locked together securely during movement. Once secured with all the rest of the components, levers 1203 and second rotational wheel 1204*b* also rotationally move along the rail 1206. The front end of the slider 1205 has two smaller brake wheels 1208 attached to it, and when these two brake wheels 1208 are moved towards the skate wheel 114 by the slider 1205, they engage the skate wheel 114 to stop it.

Figure 9A:
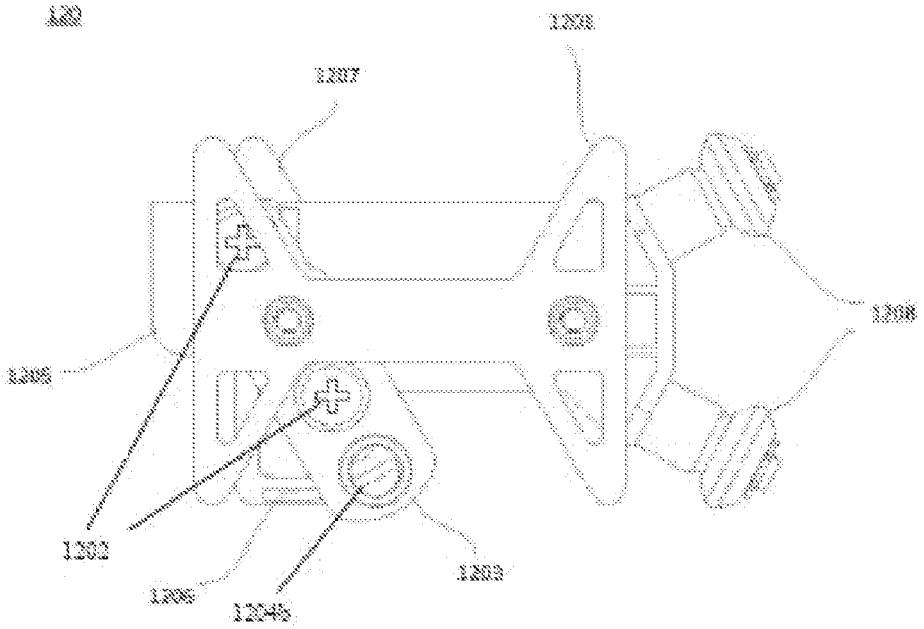
FIGS. 9A-B are top views of the lever system used in the braking mechanism on the roller skate device according to an embodiment of the present disclosure.
Figure 9B:
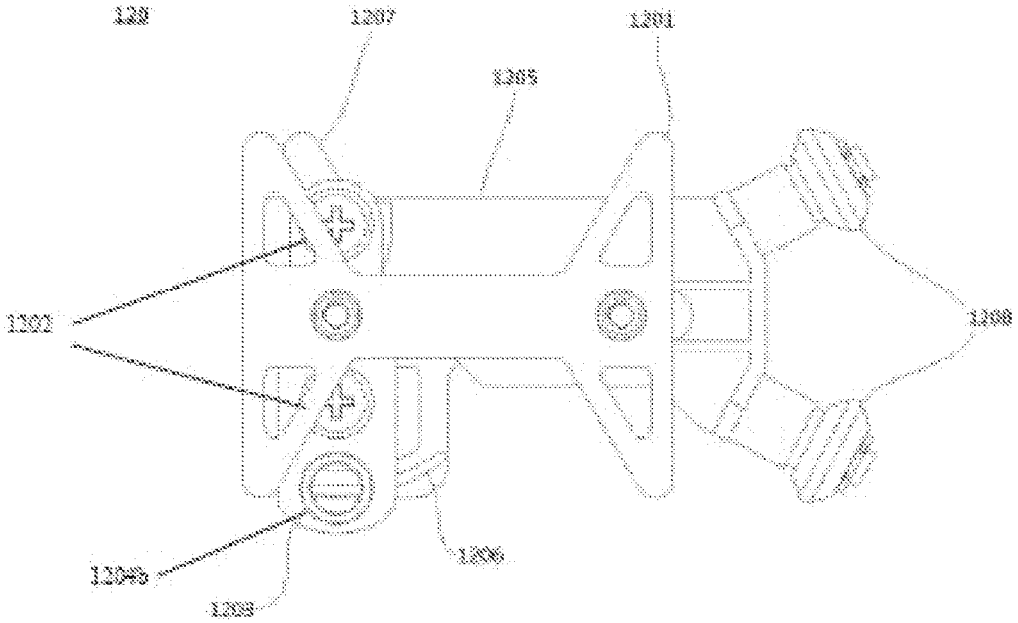

When the lever 1203 is pulled or moved along the rail 1206, it may rotate clockwise (or counter-clockwise). The rotational wheels 1204*a* and 1204*b* in turn push the slider 1205 forward (as can be seen by FIGS. 9A-B), which engages the brake wheels 1208 to the skate wheel 114 and pressures the brake wheels 1208 against the skate wheel 114. When the brake wheels 1208 are pressured against the skate wheel 114, part of the skate wheel 114 that touches the brake wheels 1208 may be pushed inward and become deformed. This temporary deformation causes the skate wheel 114 to slow down, and the speed of the slowdown is proportional to the pressure applied from the brake wheels 1208, which is in turn proportional to how much the user's leg or body is leaned backward or how much the cradle 102 leans back as well. The motion need not be a backwards motion and can be a motion in any direction, however.

To release the brake, the user simply may stand straight or lean forward, which disengages the control wire 160 and returns the slider 1205 to its original position, and therefore disengages the small brake wheels 1208 from the skate wheel 114, hence releasing any brake upon the skate wheel 114. The spring mechanism 1211 may also be positioned in a middle slot portion of the slider 1205, in between first axis 1209*a* and the second axis 1209*b*. As shown in FIG. 8B, the spring mechanism 1211 hooks onto first axis 1209*a* and another end hooks onto the slider 1205, applying a spring bias force to slider 1205. Thus the spring mechanism 1211 enables the brake mechanism to return or resume back to its original position automatically after the user releases the brake as described above by applying a spring bias force to pull slider 1205 backward.

Figure 8A:
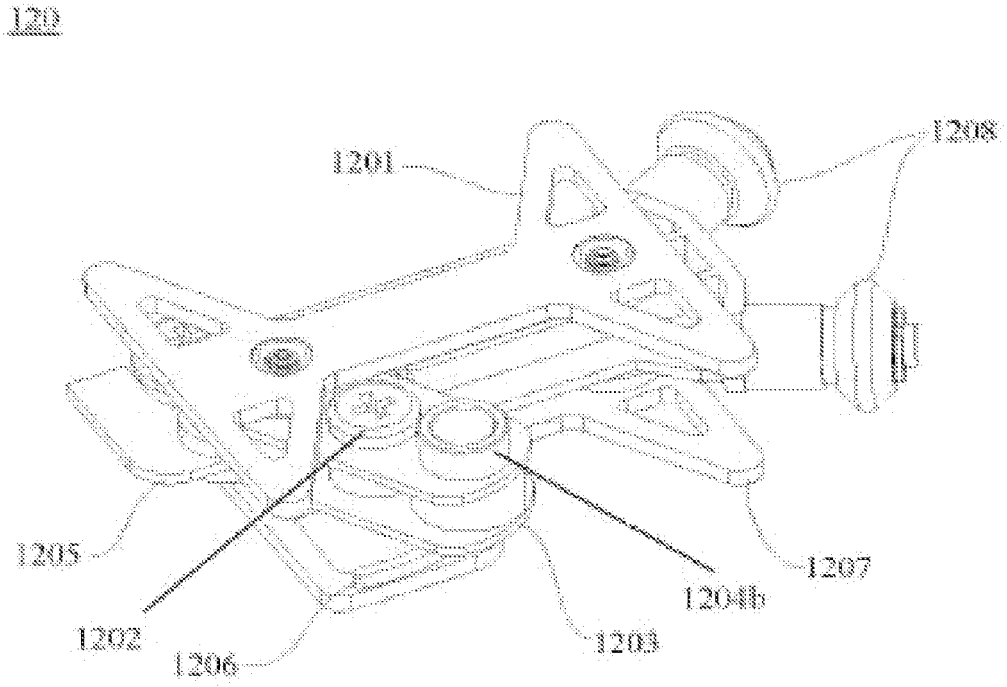
FIG. 8A is a perspective view of the lever system used in the braking mechanism on the roller skate device according to an embodiment of the present disclosure.
Figure 8B:
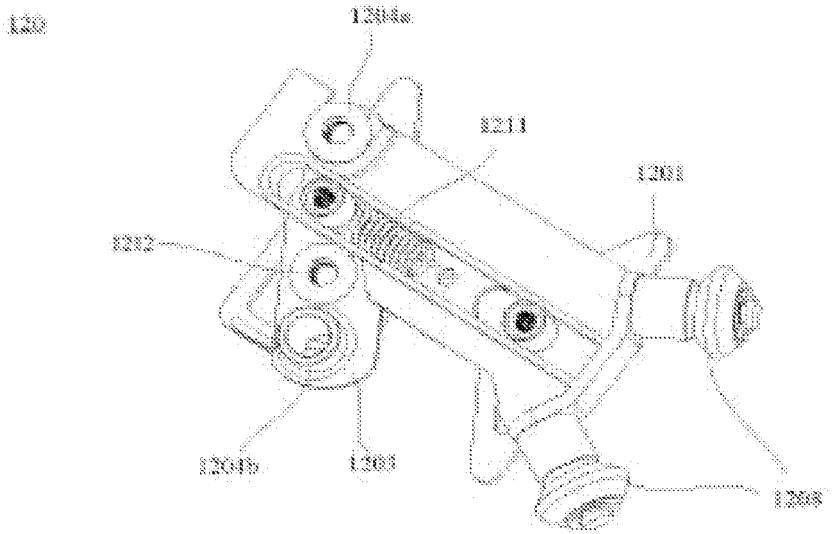
FIG. 8B is a perspective, partially exploded view of the lever system used in the braking mechanism on the roller skate device according to an embodiment of the present disclosure.

FIGS. 8A-B are perspective, partially exploded views of the lever system used in the braking mechanism on the roller skate device according to an embodiment of the present disclosure. Lever system 120 in FIG. 8A includes the same elements as the lever system 120 in FIG. 7, and as can be seen in FIG. 8A, lever system 120 includes the slider 1205, the top cap 1201, the brake wheels 1208, the levers 1203, the screws 1202, the second rotational wheel 1204*b*, the rail 1206 and the bottom cap 1207. In FIG. 8A, it can be clearly seen that the second rotational wheel 1204*b* is the component controls the movement of the levers 1203 along the rail 1206 and that engages with the hook 130, which is connected to the other end of the control wire 106, and which translates the motion from the pulled control wire 106 to the lever system 120. The screws 1202 also secure the rotational wheels 1204*a* and securer 1212 to the levers 1203 so that rotational movement may occur. FIG. 8B is perspective, partially exploded view without the top cap 1201 and the spring mechanism 1211 is clearly seen positioned in the middle slot portion of the slider 1205. The spring mechanism 1211 is positioned in the middle slot portion of the slider 1205 in between the first axis 1209*a* and the second axis 1209*b*. The spring mechanism 1211 is directly coupled to the slider 1205. The spring mechanism 1211 applies a spring bias force to the slider 1205 and pull it backward. The spring mechanism 1211 allows the entire brake mechanism functionality of the lever system 120 to return or resume back to its original position automatically by pulling the slider 1205 with a spring bias force after the user releases the brake, for example.

FIGS. 9A-B are bird's eye views of the lever system used in the braking mechanism on the roller skate device according to an embodiment of the present disclosure. Lever system 120 as shown in FIGS. 9A-B include the slider 1205, the bottom cap 1207, the levers 1203, the top cap 1201, the screws 1202, the second rotational wheel 1204*b*, the rail 1206 and the brake wheels 1208. When the levers 1203 are pulled by means of the hook 130 connected to the other end of control wire 106 (which when pulled sends momentum to the hook 130 which in turn sends momentum to the levers 1203), the levers 1203 may rotate clockwise (or counter-clockwise) along rail 1206. In FIG. 9A, the levers 1203 may be in a beginning position, and in FIG. 9B, the levers 1203 may be in an end position. In one implementation, the levers 1203 may be moved by the knob-like structure with a hole of the second rotational wheel 1204*b*. The screws 1202 also secure the rotational wheel 1204*a* and securer 1212 (not shown in FIGS. 9A-B because they are covered by the screws 1202) to the levers 1203 so that rotational movement may occur. Thus, the lever 1203, when moved, moves the rotational wheels 1204*a* and 1204*b*, which in turn pushes the slider 1205 forward. Once the slider 1205 is pushed forward, the brake wheels 1208 are engaged to the skate wheel 114 and pressure the skate wheel 114 so as to provide a braking or slowing down functionality, as discussed above.

Figure 10A:
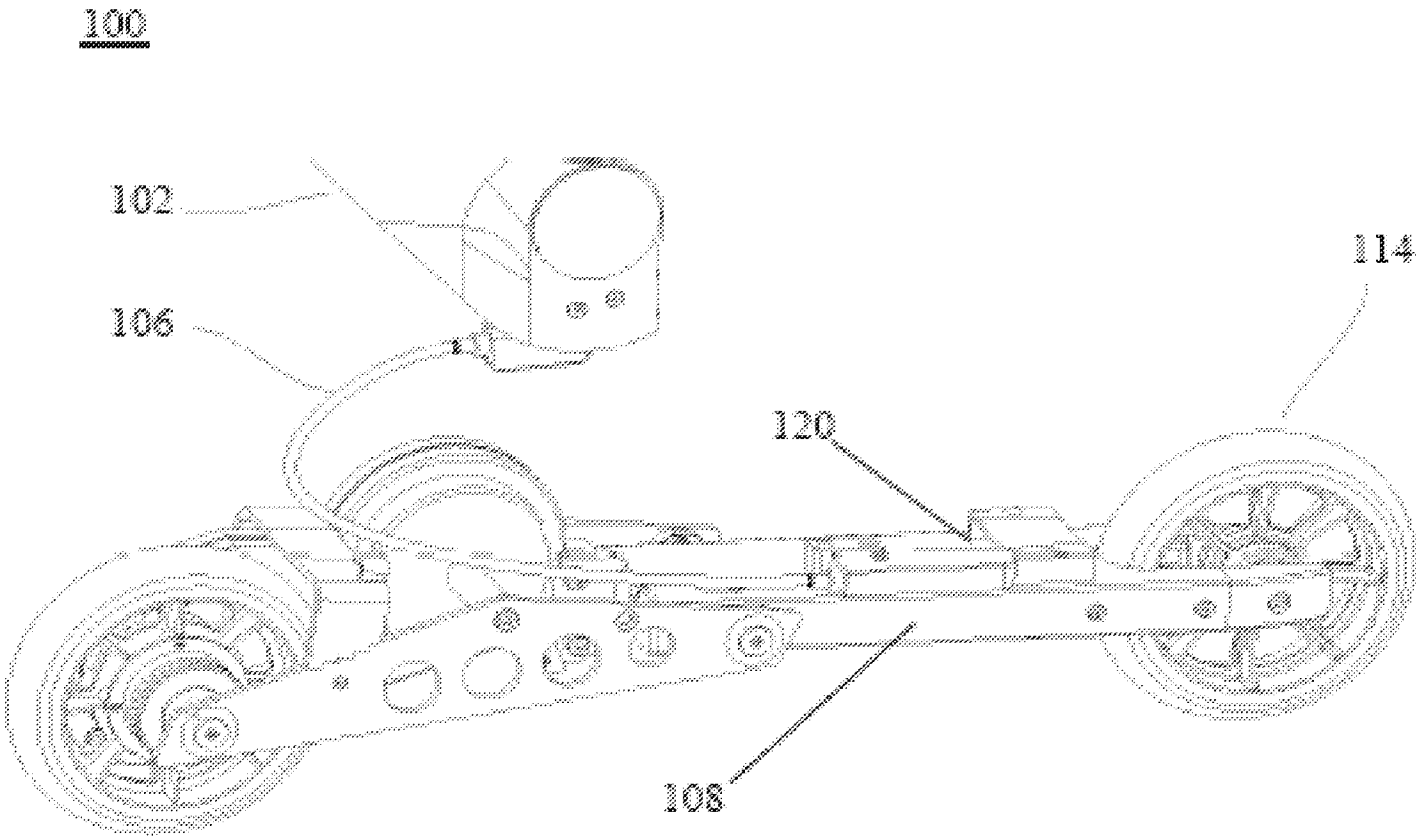
FIG. 10A is a perspective, partially exploded view of the wheels of the roller skate device and the control wire based system used for the braking mechanism according to an embodiment of the present disclosure.
Figure 10B:
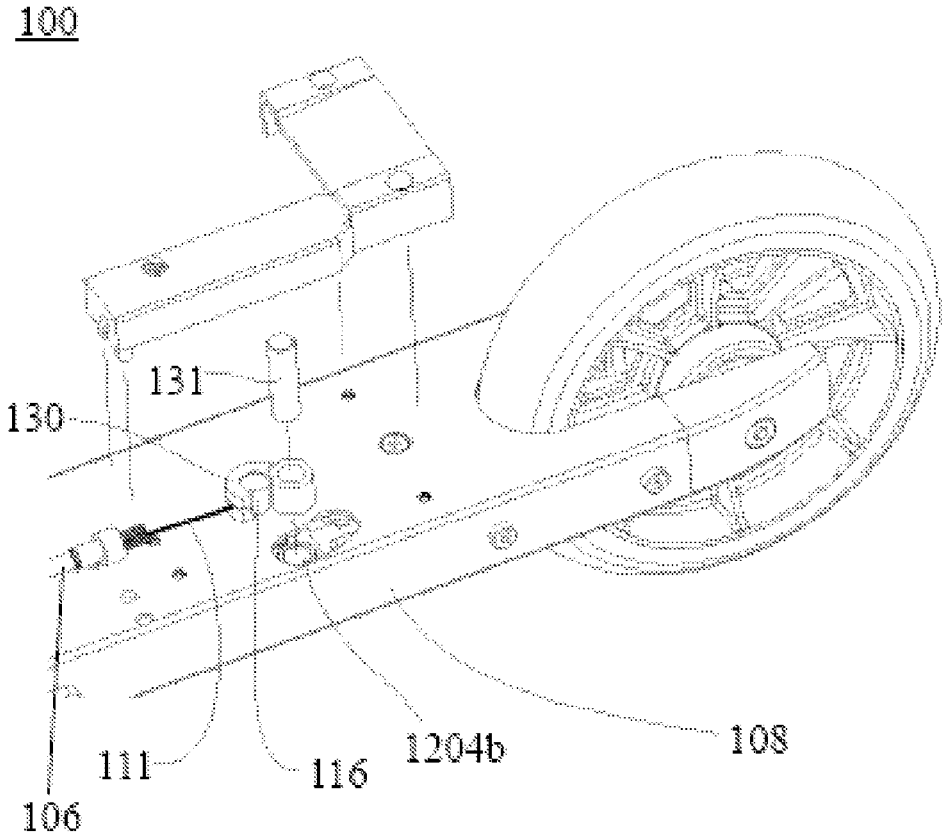
FIG. 10B is a perspective, partially exploded view of the chasis of the roller skate device showing the components that couple the control wire to the lever system used for the braking mechanism according to an embodiment of the present disclosure.

FIG. 10A is a perspective, partially exploded view of the wheels of the roller skate device and the control wire based system used for the braking mechanism according to an embodiment of the present disclosure. FIG. 10A includes cradle 102, control wire 106, chassis 108 and skate wheels 114, which were all components discussed previously. FIG. 10B is a perspective, partially exploded view of the FIG. 10B shows the peg part 116 of the control wire 106 at the end of the tension wire 111, engaged with the hook 130 which is further engaged with the second rotational wheel 1204*b* by the pin 131 passing through the holes of the hook 130 and the second rotational wheel 1204*b*. As can be seen from FIG. 10B, the lever system 120 is connected to the control wire 106, and the lever system 120 provides the functionality as described above in order to brake or slow down the skate wheels 114. In FIG. 10A-B, the various components of lever system 120 are positioned inside chassis 108.

Figure 11A:
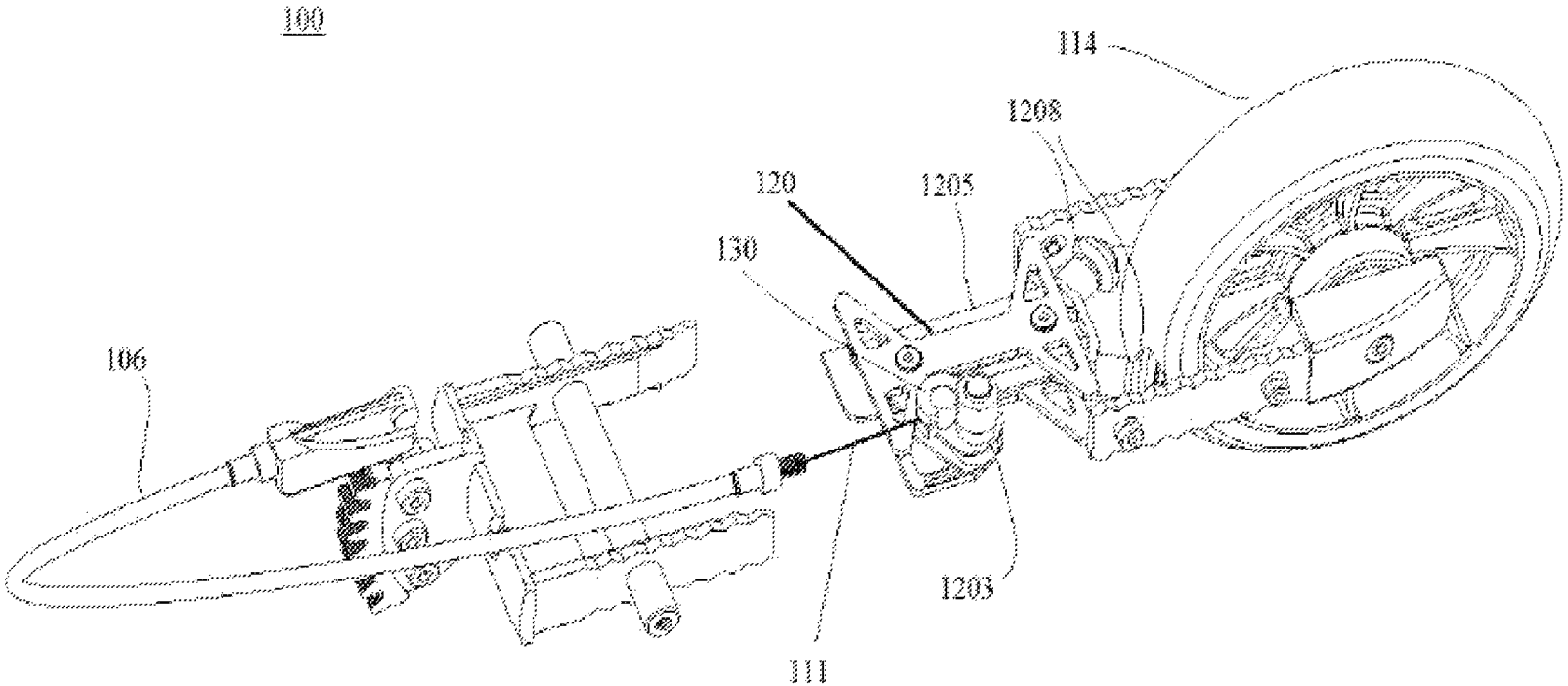
FIGS. 11A-B are perspective, partially exploded views of the wheels of the roller skate device, the control wire based system used for the braking mechanism and the lever system used in the braking mechanism according to an embodiment of the present disclosure.
Figure 11B:
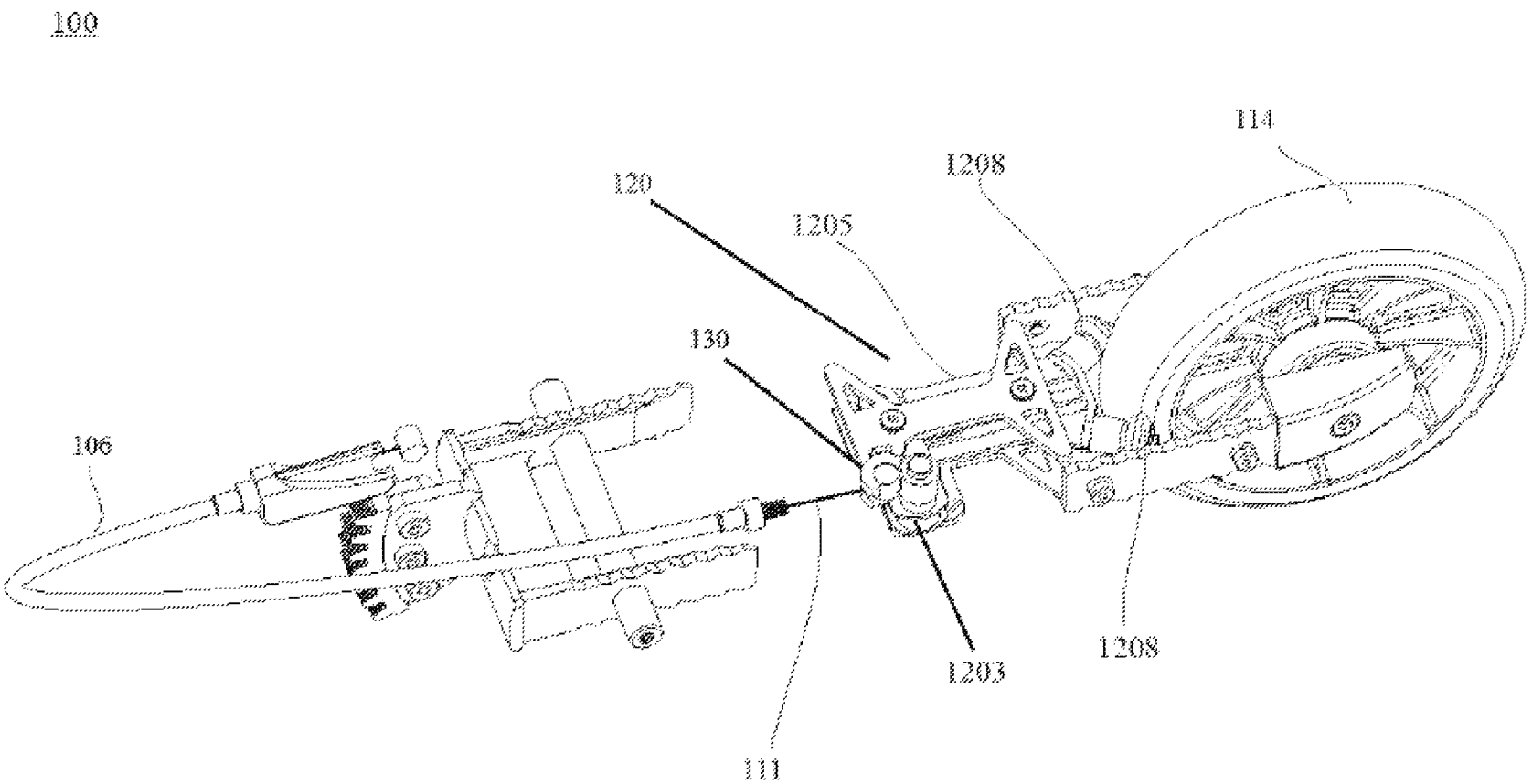

FIGS. 11A-B are perspective, partially exploded views of the wheels of the roller skate device, the control wire based system used for the braking mechanism and the lever system used in the braking mechanism according to an embodiment of the present disclosure. As can be seen by FIG. 11A, roller skate device 100 includes control wire 106, tension wire 111, hook 130, lever system 120 (which in turn includes slider 1205, lever 1203 and brake wheels 1208) and skate wheels 114. FIGS. 11A-B have certain components blown-up or revealed in order to fully illustrate the workings of the brake mechanism of the present disclosure.

As can be seen in FIG. 11A, the lever 1203 is the beginning position, the control wire 106 and tension wire 111 have not been pulled yet, the slider 1205 is in a retracted position, and the brake wheels 1208 are in a released position and not engaged with the skate wheels 114. However, in FIG. 11B, the tension wire 111 is pulled which causes the hook 130 to pull the lever 123 backward and clockwise into an ending position, which in turn causes the slider 1205 to move forward into an advanced position which finally causes the brake wheels 1208 to engage and make contact with the skate wheels 114 in order to brake and slow the skate wheels 114.

According to one embodiment, the braking mechanism of the present disclosure provides improved ergonomics for the braking capabilities of any roller skate device. A user can apply the brake with ease even when going down a slope by simply leaning backwards slightly. It also eliminates the need to "stand on one foot" during braking, which a traditional braking mechanism would require. In other words, the user has both of his or her feet available, and can still use both even while braking. The present disclosure also provides a way for the user to control precisely how much of a braking force to apply by controlling the tilt of his or her lower legs, or the motion that his or her lower legs or body makes. Since the braking mechanism does not involve using friction with the ground for braking, but instead achieves braking through the temporary deformation of the wheel, the approach of the present disclosure does away with a brake pad, and avoids the problems normally associated with a brake pad, such as frequent changing or replacement of a brake pad due to wear and tear, eventual damage to the brake pad, and safety concerns of a brake pad being so worn out in no longer works properly.

Another advantage of the design of the present disclosure is avoiding the situation where a user inadvertently applies too much braking force and starts to lose balance because the upper body is moving faster than the roller skate device. Before the user actually loses balance, momentum will carry the user's legs forward, and will thereby tilt the cradle forward. With the cradle in the forward position, the brake of the braking mechanism releases and the wheels may once again regain motion.

While particular embodiments of the present disclosure have been shown and described, it will be obvious to those skilled in the art that the present disclosure is not limited to the particular embodiments shown and described and that changes and modifications may be made without departing from the spirit and scope of the appended claims.

What is claimed is:

1. A roller skate device, comprising:

at least one skate wheel;

a rear shoe block comprising a control wire;

a cradle comprising a locking mechanism;

a lever system coupled to the control wire, the lever system comprising at least one brake wheel that applies a braking force to the at least one skate wheel based on the motion of the cradle translated through the control wire;

wherein the control wire comprises a first end having a peg connectable to the locking mechanism and a second end comprising a hook, the peg connecting to the locking mechanism and pulling the control wire when the cradle moves in a first direction, and the peg disconnecting from the locking mechanism and releasing the control wire when the cradle moves in a second direction.

2. The roller skate device of claim 1, wherein the lever system further comprises:

a lever comprising a knob connectable to the hook and which moves between a first position and a second position;

a rotational wheel coupled to the lever that translates motion from the lever as it rotates about an axis;

a slider coupled to, and receiving the translated motion from, the rotational wheel that moves between a retracted position when the lever is in the first position and an advanced position when the lever is in the second position; and at least one brake wheel connected to the slider that moves in an engaged position to engage the at least one skate wheel to apply the braking force when the slider is in the advanced position and that moves in a released position when the slider is in the retracted position.

3. The roller skate device of claim 1, wherein the locking mechanism comprises a hook shape screwed to the cradle by at least one screw, the hook shape being shaped in a manner to lock firmly with the peg.

4. The roller skate device of claim 1, wherein the control wire comprises an outer protective sheath and an inner tension wire that may withstand large amounts of tension.

5. The roller skate device of claim 2, wherein the lever comprises a top lever portion and a bottom lever portion and the lever system further comprises:

one or more axes;

a top cap coupled to the top lever portion and the upper ends of the one or more axes;

a bottom cap coupled to the bottom lever and the lower ends of the one or more axes;

the slider having one or more longitudinal openings where the one or more axes sit in;

the slider being able to slide guided by the one or more axes to position itself in the advanced position or retracted position.

6. The roller skate device of claim 1, further comprising:

at least one securing apparatus comprising at least one strap and at least one strap buckle, velcro, and adhesives;

at least one toe cap, the at least one toe cap comprising padding;

a base providing an area for the sole of a foot to rest; and a chassis connected to the base and the at least one skate wheel to provide support for the base.

7. A roller skate device, comprising:

at least one skate wheel;

a cradle comprising a locking mechanism;

a rear shoe block comprising a control wire comprising a first end having a peg connectable to the locking mechanism and a second end comprising a hook, the peg connecting to the locking mechanism and pulling the control wire when the cradle moves in a first direction, and the peg disconnecting from the locking mechanism and releasing the control wire when the cradle moves in a second direction;

a lever system comprising:

a lever comprising a knob connectable to the hook and which moves between a first position and a second position;

a rotational wheel coupled to the lever that translates motion from the lever as it rotates about an axis;

a slider coupled to, and receiving the translated motion from, the rotational wheel that moves between a retracted position when the lever is in the first position and an advanced position when the lever is in the second position; and at least one brake wheel connected to the slider that moves in an engaged position to engage the at least one skate wheel to provide a braking force when the slider is in the advanced position and that moves in a released position when the slider is in the retracted position.

8. The roller skate device of claim 7, wherein the locking mechanism comprises a case having a hook shape screwed together to the cradle by at least one screw, the hook shape being shaped in a manner to lock firmly with the peg.

9. The roller skate device of claim 7, wherein the control wire comprises an outer protective sheath and an inner tension wire that may withstand large amounts of tension.

10. The roller skate device of claim 7, wherein the lever comprises a top lever portion and a bottom lever portion and the lever system further comprises:

one or more axes;

a top cap coupled to the top lever and the upper ends of the one or more axes;

a bottom cap coupled to the bottom lever and the lower ends of the one or more axes;

the slider being able to slide guided by the one or more axes to position itself in the advanced position or retracted position.

11. The roller skate device of claim 2, further comprising a spring mechanism that is positioned in a middle slot portion of the slider and coupled to the slider, and which also applies a spring bias force to the slider to enable the lever system to reset itself back to its original position automatically when the cradle moves in a second direction releasing the control wire.

12. The roller skate device of claim 7, further comprising:

at least one securing apparatus comprising at least one strap and at least one strap buckle, velcro, and adhesives;

at least one toe cap, the at least one toe cap comprising padding;

a base providing an area for the sole of a foot to rest; and a chassis connected to the base and the at least one skate wheel to provide support for the base.

13. A roller skate device, comprising:

at least one skate wheel;

a cradle comprising a locking mechanism;

a rear shoe block comprising a control wire comprising a first end having a peg connectable to the locking mechanism and a second end comprising a hook, the peg connecting to the locking mechanism and pulling the control wire when the cradle moves in a first direction, and the peg disconnecting from the locking mechanism and releasing the control wire when the cradle moves in a second direction;

a lever system comprising:

a lever comprising a knob connectable to the hook and which moves between a first position and a second position;

a rotational wheel coupled to the lever that translates motion from the lever as it rotates about an axis;

a slider coupled to, and receiving the translated motion from, the rotational wheel that moves between a retracted position when the lever is in the first position and an advanced position when the lever is in the second position;

at least one brake wheel connected to the slider that moves in an engaged position to engage the at least one skate wheel to provide a braking force when the slider is in the advanced position and that moves in a released position when the slider is in the retracted position;

at least one securing apparatus comprising at least one strap and at least one strap buckle, velcro, and adhesives;

at least one toe cap, the at least one toe cap comprising padding;

a base providing an area for the sole of a foot to rest; and a chassis connected to the base and the at least one skate wheel to provide support for the base.

14. The roller skate device of claim 13, wherein the locking mechanism comprises a case having a hook shape screwed together to the cradle by at least one screw, the hook shape being shaped in a manner to lock firmly with the peg.

15. The roller skate device of claim 13, wherein the control wire comprises an outer protective sheath and an inner tension wire that may withstand large amounts of tension.

16. The roller skate device of claim 13, wherein the lever comprises a top lever portion and a bottom lever portion and the lever system further comprises:

one or more axes;

the slider having one or more longitudinal openings where the one or more axes sit in;

a top cap coupled to the top lever portion and the upper ends of the one or more axes;

a bottom cap coupled to the bottom lever portion and the bottom ends of the one or more axes, the slider being able to slide guided by the one or more axes to position itself in the advanced position or retracted position.

17. The roller skate device of claim 13, further comprising a spring mechanism that is positioned in a bottom slot portion of the slider and coupled to the slider, and which also applies a spring bias force to the lever to enable the lever system to reset itself back to its original position automatically when the cradle moves in a second direction releasing the control wire.

18. A roller skate device, comprising:

at least one skate wheel;

a cradle comprising a locking mechanism;

a rear shoe block comprising a control wire comprising a first end having a peg connectable to the locking mechanism and a second end comprising a hook, the peg connecting to the locking mechanism and pulling the control wire when the cradle moves in a first direction, and the peg disconnecting from the locking mechanism and releasing the control wire when the cradle moves in a second direction;

a lever system comprising:

a lever comprising a knob connectable to the hook and which moves between a first position and a second position;

a rotational wheel coupled to the lever that translates motion from the lever as it rotates about an axis;

a slider coupled to, and receiving the translated motion from, the rotational wheel that moves between a retracted position when the lever is in the first position and an advanced position when the lever is in the second position;

at least one brake wheel connected to the slider that moves in an engaged position to engage the at least one skate wheel to provide a braking force when the slider is in the advanced position and that moves in a released position when the slider is in the retracted position;

one or more axes;

the slider having one or more longitudinal openings where the one or more axes sit in;

a top cap coupled to the top lever portion and the upper ends of the one or more axes;

a bottom cap coupled to the bottom lever portion and the bottom ends of the one or more axes, the slider being able to slide guided by the one or more axes to position itself in the advanced position or refracted position.

* * * * *